US010916228B1

(12) United States Patent
Elias

(10) Patent No.: US 10,916,228 B1
(45) Date of Patent: Feb. 9, 2021

(54) MUSICAL INSTRUMENT WITH VIBRATING RODS TO GENERATE SOUND

(71) Applicant: Diego Elias, Palm Desert, CA (US)

(72) Inventor: Diego Elias, Palm Desert, CA (US)

( * ) Notice: Subject to any disclaimer, the term of this patent is extended or adjusted under 35 U.S.C. 154(b) by 0 days.

(21) Appl. No.: 16/835,634

(22) Filed: Mar. 31, 2020

(51) Int. Cl.

| | |
|---|---|
| ***G10D 13/08*** | (2020.01) |
| ***G10H 3/20*** | (2006.01) |
| ***G10D 13/10*** | (2020.01) |
| ***G10H 3/14*** | (2006.01) |

(52) U.S. Cl.
CPC ..... *G10D 13/08* (2013.01); *G10D 13/10* (2020.02); *G10H 3/20* (2013.01); *G10H 3/143* (2013.01)

(58) Field of Classification Search
CPC ..... G10D 13/10; G10D 13/08; G10H 3/143; G10H 3/20
USPC ..... 84/402, 403, 410
See application file for complete search history.

(56) References Cited

U.S. PATENT DOCUMENTS

| | | | | | |
|---|---|---|---|---|---|
| 864,461 | A * | 8/1907 | Gibbs | G04B 21/08 | 116/169 |
| 3,048,071 | A * | 8/1962 | Kunz | G10H 3/20 | 84/698 |
| 3,167,994 | A * | 2/1965 | Baschet | G10K 13/00 | 84/404 |
| 3,633,453 | A * | 1/1972 | Musser | G10K 1/10 | 84/403 |
| 3,649,737 | A * | 3/1972 | Jespersen | G10H 3/20 | 84/725 |
| 3,896,696 | A * | 7/1975 | Waters | G10D 13/08 | 84/403 |
| 4,184,398 | A * | 1/1980 | Siegelman | G10H 3/20 | 335/302 |
| 4,543,871 | A * | 10/1985 | Kvistad | G10D 13/08 | 84/403 |
| 4,885,972 | A * | 12/1989 | Chen | G10D 13/08 | 84/403 |
| 4,941,386 | A * | 7/1990 | Stevens | G10D 13/08 | 84/359 |
| 6,150,600 | A * | 11/2000 | Buchla | G10H 1/0555 | 84/688 |
| 7,732,691 | B2 * | 6/2010 | Stevens | G10D 13/08 | 84/403 |
| 10,692,479 | B2 * | 6/2020 | Abe | G10H 3/143 | |
| 10,777,181 | B2 * | 9/2020 | Topel | G10H 3/18 | |
| 2002/0073824 | A1 * | 6/2002 | Adams | G10D 13/08 | 84/402 |
| 2010/0037756 | A1 * | 2/2010 | May | G10D 13/08 | 84/723 |

(Continued)

*Primary Examiner* — Jeffrey Donels
(74) *Attorney, Agent, or Firm* — Plager Schack LLP; Mark H. Plager; Eric Liou

(57) ABSTRACT

A musical instrument with vibrating rods to generate a sound is provided. The musical instrument includes an acoustic housing having a main body with a first opening and a second opening, a plurality of rods coupled to the acoustic housing and extending beyond the first opening in the main body of the acoustic housing, and a plurality of electromagnetic pickups coupled to the acoustic housing and extending beyond the first opening in the main body of the acoustic housing. The vibration of any one of the plurality of rods enables a corresponding one of the plurality of electromagnetic pickups to generate an electrical signal corresponding to the sound.

10 Claims, 5 Drawing Sheets

(56) References Cited

U.S. PATENT DOCUMENTS

| | | | | |
|---|---|---|---|---|
| 2012/0067197 | A1* | 3/2012 | May | G10D 13/08 84/723 |
| 2013/0047819 | A1* | 2/2013 | Stevens | G10D 13/08 84/410 |
| 2018/0286362 | A1* | 10/2018 | Barnes | G10D 17/00 |
| 2019/0304425 | A1* | 10/2019 | Topel | G10H 3/26 |
| 2020/0227017 | A1* | 7/2020 | Glowka | G10H 3/14 |

* cited by examiner

MUSICAL INSTRUMENT WITH VIBRATING RODS TO GENERATE SOUND

BACKGROUND

The embodiments herein relate generally to musical instruments. More specifically, embodiments of the invention are directed to a musical instrument with vibrating rods that generate sound.

Musicians often strive to distinguish themselves from other musical artists by focusing on variations in their musical style and stage presence. Different instruments are frequently used to play a wide range of sounds with variable tones and tempos. Another manner in which to generate unique sounds and music is through the use of a novel musical instrument.

As such, there is a need in the industry for a novel musical instrument having a series of vibrating rods that addresses the limitations of the prior art, which allows a user to produce a unique series of sounds to generate music.

SUMMARY

In certain embodiments of the invention, a musical instrument with vibrating rods to generate a sound is provided. The musical instrument comprises an acoustic housing comprising a main body with a first opening and a second opening, the housing comprising an internal cavity within the main body extending from the first opening to the second opening, a plurality of rods coupled to the acoustic housing, each rod in the plurality of rods extending beyond the first opening in the main body of the acoustic housing, and a plurality of electromagnetic pickups coupled to the acoustic housing, each electromagnetic pickup in the plurality of electromagnetic pickups extending beyond the first opening in the main body of the acoustic housing within a portion of the plurality of rods, wherein a vibration of any one of the plurality of rods enables a corresponding one of the plurality of electromagnetic pickups to generate an electrical signal corresponding to the sound.

In one embodiment, the musical instrument comprises an acoustic housing comprising a main body with a first opening and a second opening, a plurality of rods coupled to the acoustic housing, a ferromagnetic cap coupled to the second opening of the main body of the acoustic housing, and an electromagnetic pickup coupled to the acoustic housing and separated a distance away from the ferromagnetic cap, wherein a vibration of any one of the plurality of rods enables the main body of the acoustic housing and ferromagnetic cap to resonate, thereby enabling the electromagnetic pickup to generate an electrical signal corresponding to the sound.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In certain embodiments as depicted in FIGS. 1-4, musical instrument 10 generally comprises acoustic housing 12, a plurality of rods 14 and cap 18. Vibrations in any number of the plurality of rods 14 transfer to acoustic housing 12, thereby enabling the housing to resonate and create a series of sounds.

Figure 1:
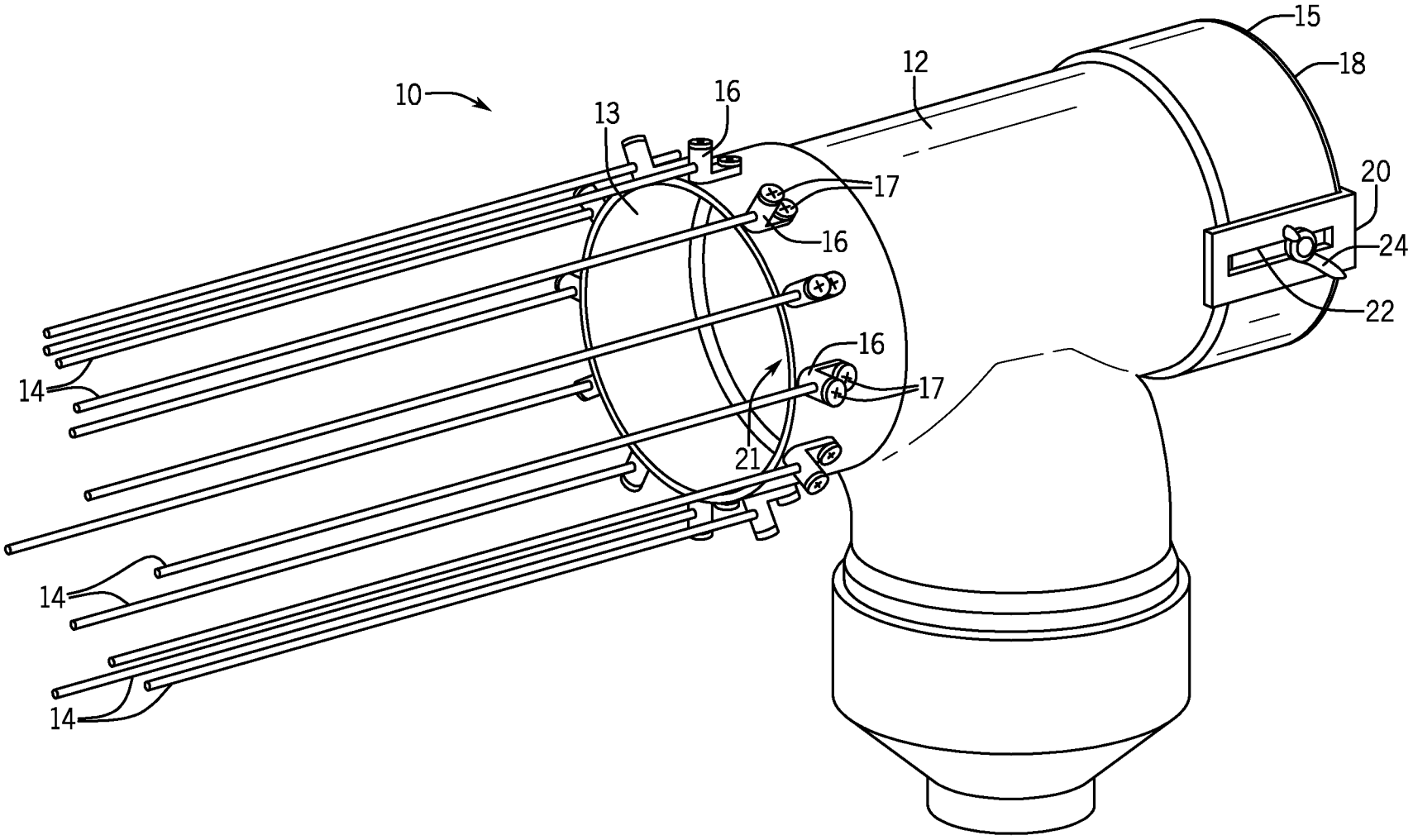
FIG. 1 depicts a top perspective view of certain embodiments of the musical instrument.
Figure 2:
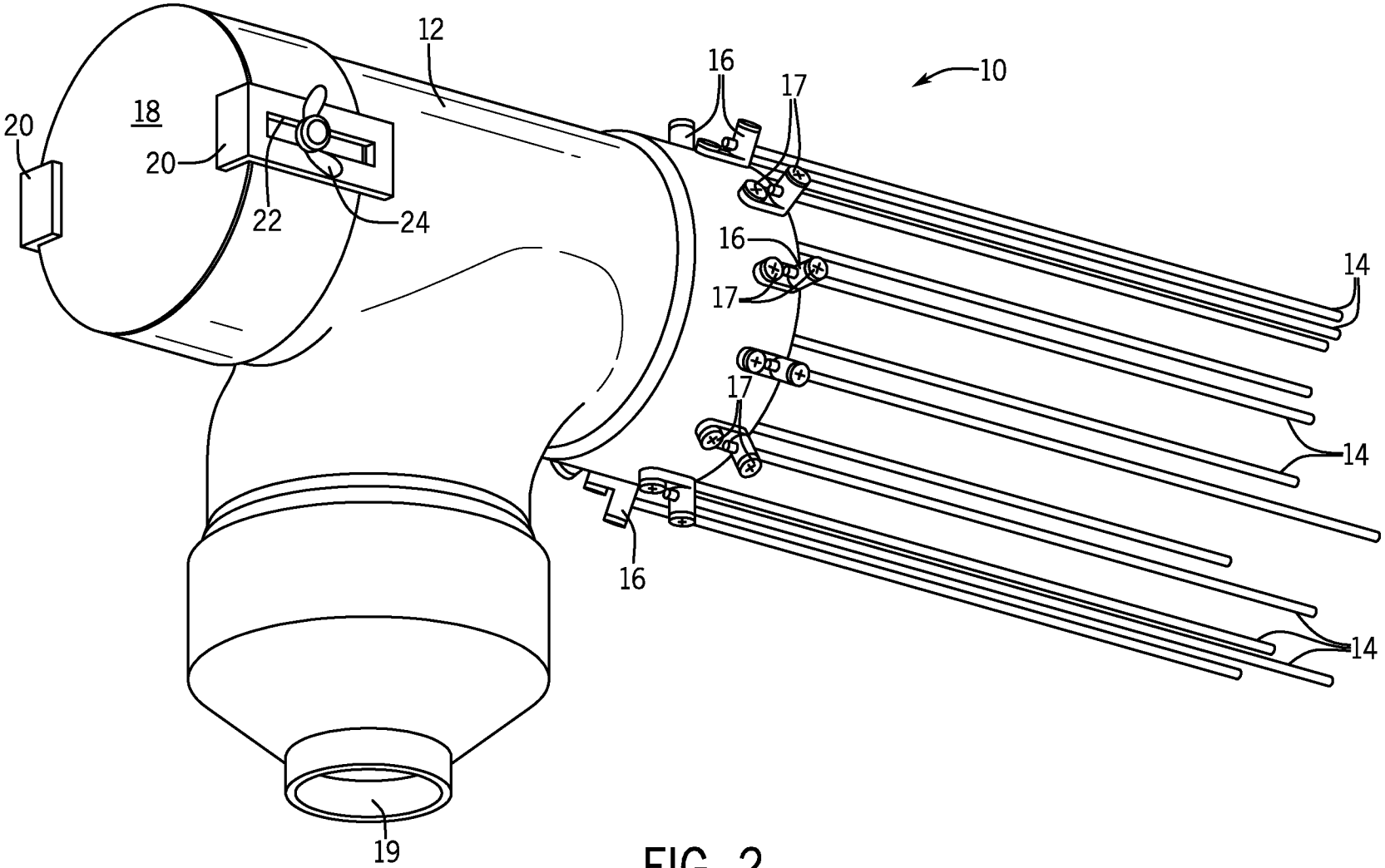
FIG. 2 depicts a bottom perspective view of certain embodiments of the musical instrument.
Figure 4:
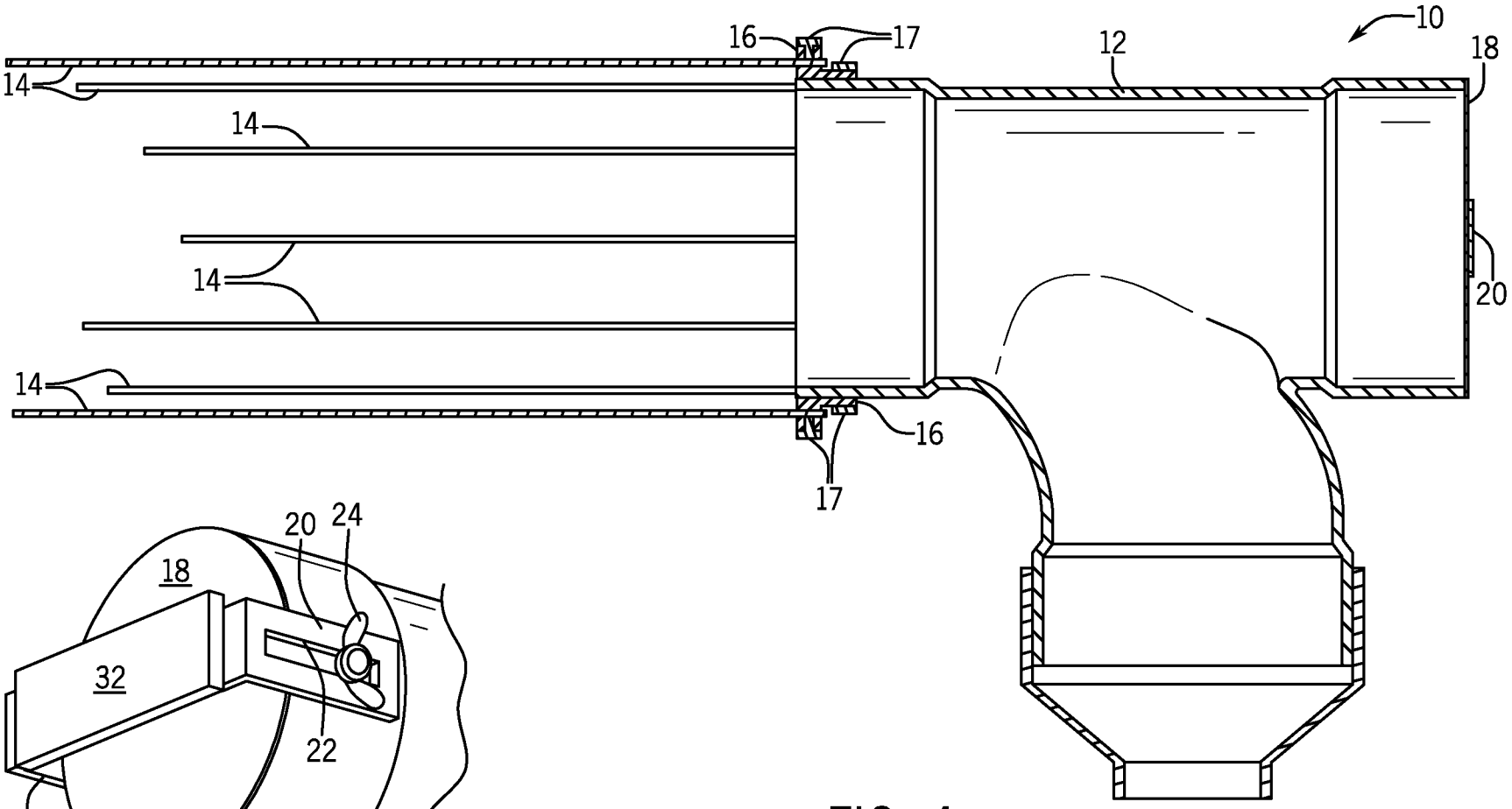
FIG. 4 depicts a cross-sectional view of certain embodiments of the musical instrument taken along line 4-4 of FIG. 3.

In one embodiment as depicted in FIGS. 1-2 and 4, acoustic housing 12 comprises a main body with first opening 13, second opening 15 and third opening 19. Acoustic housing 12 is formed by internal cavity 21, which connects first, second and third openings 13, 15, 19 in the main body together. In one embodiment, acoustic housing 12 is made from polyvinyl chloride (PVC) plastic. However, acoustic housing 12 can be made from other materials including, but not limited to, other plastics, woods, metals or other materials. It shall be appreciated that the dimensions and/or shape of acoustic housing 12, first opening 13, second opening 15 and third opening 19 can vary to alter the sound characteristics that are achieved by musical instrument 10.

In one embodiment as depicted in FIGS. 1-4, a plurality of rods 14 are coupled to the main body of acoustic housing 12. In one embodiment, first ends of the plurality of rods 14 are coupled to the main body proximate first opening 13 using rod holders 16. Screws 17 are used to both secure rod holders 16 to acoustic housing 12 and secure the plurality of rods 14 to rod holders 16. In this secured position, rods 14 extend beyond first opening 13 and are oriented generally parallel to each other. In an alternative embodiment, rods 14 can be coupled to acoustic housing 12 using adhesives or other fastening components known in the field.

In one embodiment, rods 14 are preferably arranged on acoustic housing 12 along the perimeter of first opening 13 and are equally spaced apart from each other. However, it shall be appreciated that the spacing between adjacent rods 14 and locations where rods 14 are coupled to acoustic housing 12 can vary in alternative embodiments. In one embodiment, the plurality of rods 14 are preferably made from steel. However, rods 14 can be made from other ferromagnetic metals or materials, plastic, wood or other materials.

Figure 3:
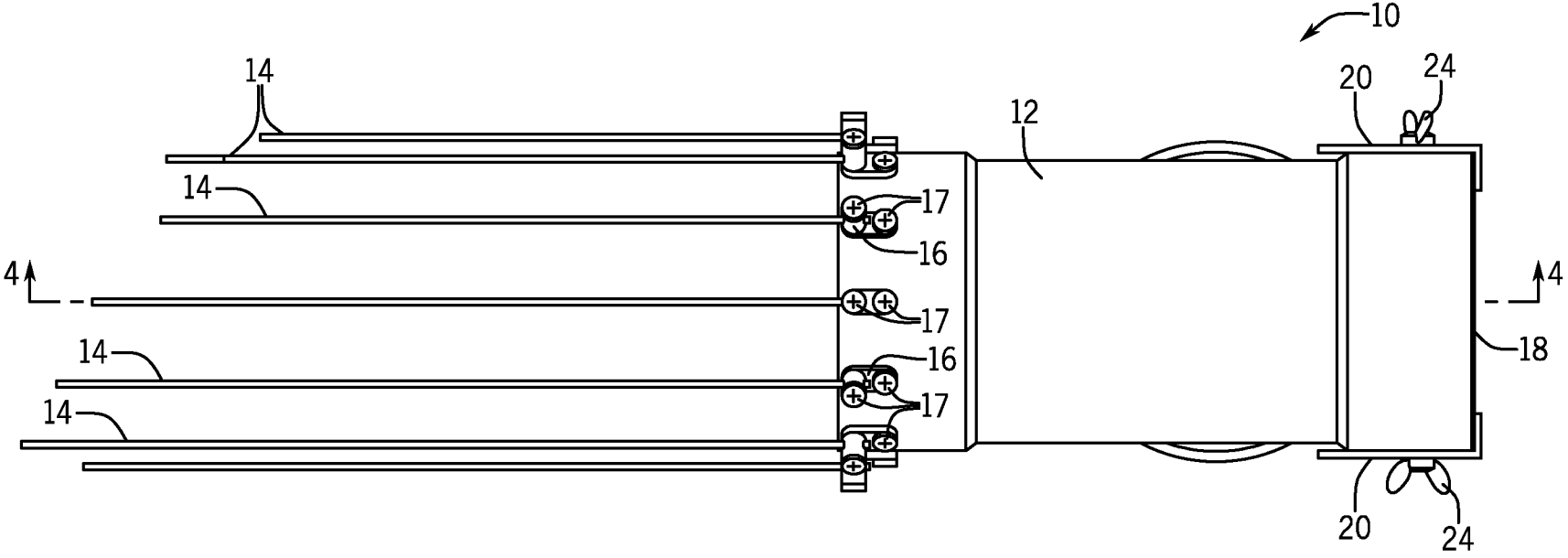
FIG. 3 depicts a top view of certain embodiments of the musical instrument.

In a preferred embodiment as depicted in FIG. 3, the plurality of rods 14 comprise different lengths to allow vibrations of different rods 14 to achieve sounds corresponding to different notes and octaves. In an alternative embodiment, it shall be appreciated that several rods 14 can have the same length. In one embodiment, the lengths of rods 14 comprise a length in the approximate range of 2"-48". In one embodiment, rods 14 are made from steel or another metal, and comprises a diameter in the approximate range of 0.032"-0.055". In one embodiment, rods 14 comprise a larger diameter if made from wood. Although the figures illustrate the musical instrument as having twelve rods 14, it shall be appreciated that any alternative number of rods 14 can be used in alternative embodiments.

In one embodiment as depicted in FIGS. 1-5, cap 18 is coupled to second opening 15 of acoustic housing 12 using an adhesive, mechanical fasteners or other fastening components. Cap 18 is preferably made from steel or any ferromagnetic metal. However, other materials can be used. In one embodiment, a pair of L-shaped clamps 20 is coupled to acoustic housing 12 proximate second opening 15 on the main body. Each L-shaped clamp 20 comprises slot 22 that permits wing nut 24 to extend through and engage with a corresponding opening in the side wall of the main body of acoustic housing 12. As such, L-shaped clamps 20 are slidably mounted to the main body of acoustic housing 12.

Figure 5:
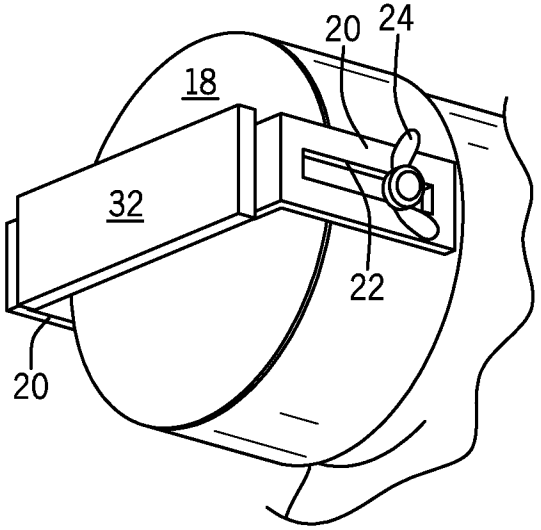
FIG. 5 depicts a perspective view of certain embodiments of the musical instrument.

In one embodiment as depicted in FIG. 5, main electromagnetic pickup 32 is coupled to the outer faces of L-shaped clamps 20, and is slidably mounted to acoustic housing 12. In this connection, main electromagnetic pickup 32 is facing down towards cap 18 and is separated a distance from cap 18 to ensure proper operation of the pickup. The pair of wing nuts 24 is loosened to enable the pair of L-shaped clamps 20 to slide relative to acoustic housing 12, thereby adjusting the distance between main electromagnetic pickup 32 and cap 18. The pair of wing nuts 24 is tightened to acoustic housing 12 to lock L-shaped clamps 20 and main electromagnetic pickup 32 in place.

It shall be appreciated that main electromagnetic pickup 32 can be coupled to L-shaped clamps 20 in various ways. In one embodiment, electromagnetic pickup 32 comprises a pair of flaps (not shown) on opposing ends that couples to L-shaped clamps 20 using an adhesive, mechanical fasteners or other fastening components. It shall be appreciated that the size and/or shape of L-shaped clamps 20 and the size and/or shape of L-shaped clamps 20 can vary in alternative embodiments to ensure a sturdy connection between main electromagnetic pickup 32 and acoustic housing 12.

In operation, a user contacts any number of rods 14 using a bow, pick, hand and/or fingers or other manner as desired. Vibrations of the selected rods 14 transfer to acoustic body 12 and cap 18. This allows acoustic housing 12 and cap 18 to resonate, thereby generating a sound or series of sounds. In one embodiment, main electromagnetic pickup 32 is electrically coupled to an amplifier and speaker as is known in the field. Main electromagnetic pickup 32 detects changes in its generated magnetic field caused by vibrations of ferromagnetic cap 18, and transmits an electrical signal corresponding to the generated sound or series of sounds from musical instrument 10 to the amplifier/speaker. It shall be appreciated that musical instrument 10 can be used without main electromagnetic pickup 32 to generate one or more sounds solely from the resonance of acoustic housing 12 and cap 18.

Figure 6:
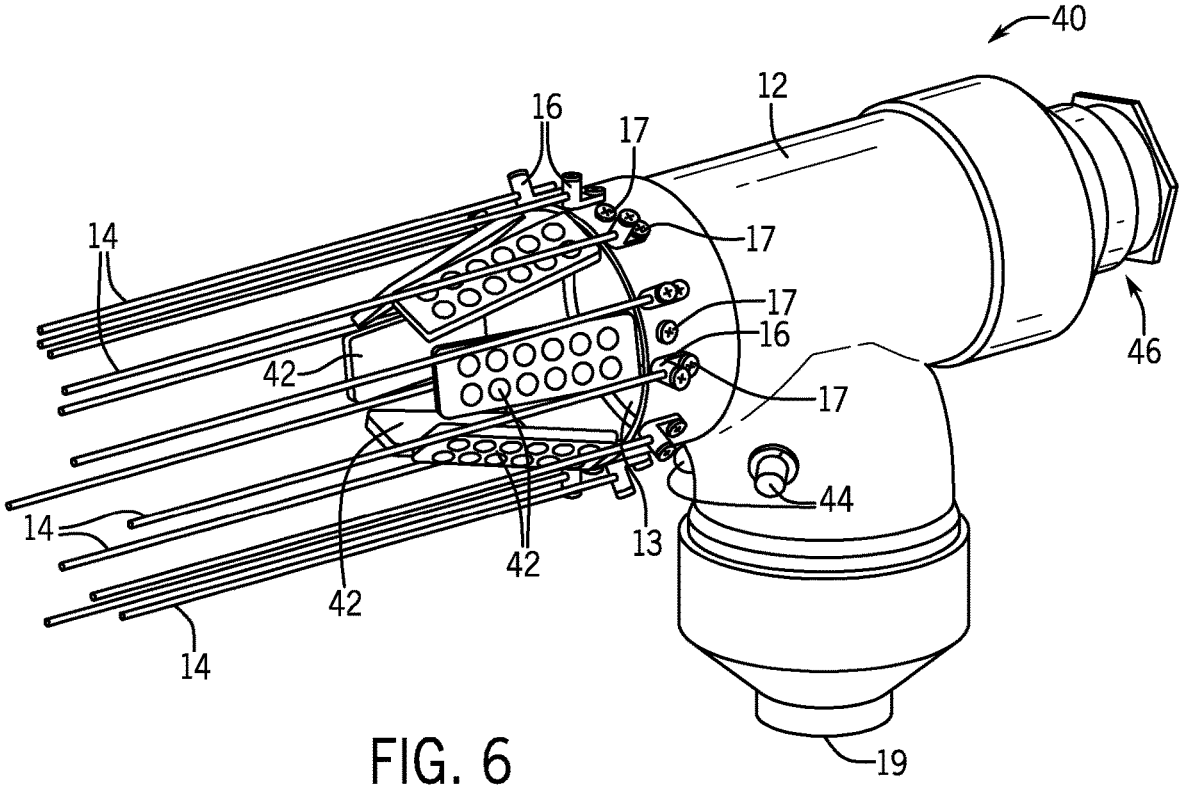
FIG. 6 depicts a top perspective view of an alternative embodiment of the musical instrument.
Figure 7:
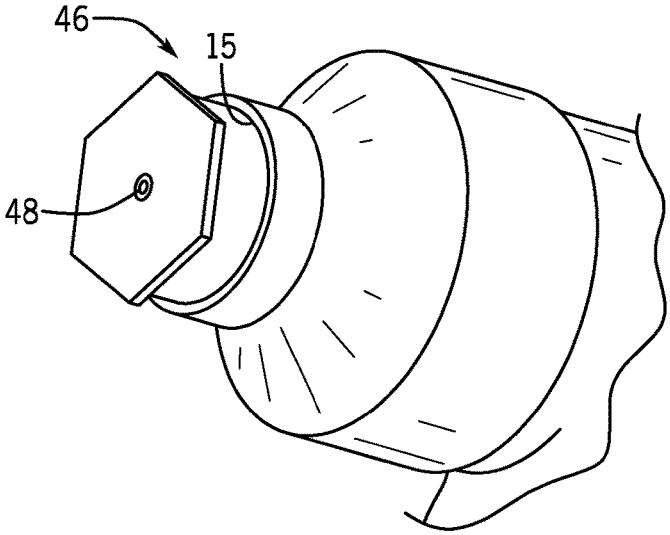
FIG. 7 depicts a perspective view of the alternative embodiment of the musical instrument.

In an alternative embodiment as depicted in FIGS. 6-7, alternate musical instrument 40 comprises several of the same components of musical instrument 10 previously described including acoustic housing 12 and rods 14. In this embodiment, rods 14 of alternate musical instrument 40 are made from a ferromagnetic metal or material.

In this embodiment, alternate musical instrument 40 comprises a plurality of electromagnetic pickups 42 coupled to acoustic housing 12 using any fastening components known in the field such as screws 17 or other fasteners. The plurality of electromagnetic pickups 42 extend beyond first opening 13 of acoustic housing 12 and within the plurality of rods 14. In one embodiment, each electromagnetic pickup 42 faces outward toward a pair of adjacent rods 14 and is separated a distance from the corresponding pair of rods 14 to ensure proper operation of the pickup. In an alternative embodiment, any alternate number of electromagnetic pickups 42 can be coupled to acoustic housing 12 to accommodate any number of rods 14.

In one embodiment as depicted in FIGS. 6-7, end cap 46 is coupled to second opening 15 of acoustic housing 12 using an adhesive, mechanical fasteners or other fastening components. Audio output connector 48 is coupled to end cap 46 and is operably connected to the plurality of electromagnetic pickups 42 by plugs and/or wires. Audio output connector 48 is electrically coupled to an amplifier and speaker as is known in the field. In one embodiment, audio output connector 48 is a ¼" audio connector, but can be any other type of connector known in the field.

In operation, a user contacts any number of rods 14 using a bow, pick, hand and/or fingers or other manner as desired. The corresponding one or more electromagnetic pickups 42 detect changes in their generated magnetic field caused by vibrations of the selected one or more rods 14, thereby enabling the one or more electromagnetic pickups 42 to transmit electrical signals corresponding to the generated sound to audio output connector 48. The electrical signals transmit from audio output connector 48 to the connected amplifier and speaker to project the generated sound.

At the same time, vibrations of the selected rods 14 transfer to acoustic body 12. This allows acoustic housing 12 to resonate and generate a sound or series of sounds. As such, alternate musical instrument 40 can generate a series of musical sounds solely from the vibrations of rods 14 and acoustic body 12 without the activation and use of electromagnetic pickups 42.

In one embodiment as depicted in FIG. 6, a pair of knobs 44 is coupled to the main body of acoustic housing 12 and is operably connected to the plurality of electromagnetic pickups 42. In one embodiment, a first knob 44 is configured to adjust the volume of the generated sound in the electrical signal. In one embodiment, a second knob 44 is configured to adjust the tone and/or equalization of the generated sound in the electrical signal.

In an alternative embodiment, variations in the size, shape and/or materials of acoustic housing 12 are possible to alter the sound characteristics generated by musical instruments 10, 40. It shall be appreciated that the components of the musical instrument described in several embodiments herein may comprise any alternative known materials in the field and be of any color, size and/or dimensions. It shall be appreciated that the components of the musical instrument described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A musical instrument with vibrating rods to generate a sound, the musical instrument comprising:

an acoustic housing comprising a main body with a first opening and a second opening, the housing comprising an internal cavity within the main body extending from the first opening to the second opening;

a plurality of rods coupled to the acoustic housing, each rod in the plurality of rods extending beyond the first opening in the main body of the acoustic housing; and a plurality of electromagnetic pickups coupled to the acoustic housing, each electromagnetic pickup in the plurality of electromagnetic pickups extending beyond the first opening in the main body of the acoustic housing;

wherein a vibration of any one of the plurality of rods enables a corresponding one of the plurality of electromagnetic pickups to generate an electrical signal corresponding to the sound.

2. The musical instrument of claim 1, further comprising an audio output connector coupled to the second opening of the acoustic housing and operably connected to the plurality of electromagnetic pickups, wherein the electrical signal corresponding to the sound from the one of the plurality of rods transmits to the audio output connector.

3. The musical instrument of claim 2, wherein the plurality of rods are made from a ferromagnetic metal.

4. The musical instrument of claim 3, wherein each rod in the plurality of rods comprises a first length that is different than a second length of another rod in the plurality of rods.

5. The musical instrument of claim 4, further comprising a pair of knobs coupled to the acoustic housing and operably connected to the plurality of electromagnetic pickups, a first knob in the pair of knobs configured to adjust a volume of the sound associated with the electrical signal, a second knob in the pair of knobs configured to adjust a tone of the sound associated with the electrical signal.

6. The musical instrument of claim 5, wherein the main body of the acoustic housing comprises a third opening.

7. The musical instrument of claim 5, wherein each rod in the plurality of rods comprises a first end mechanically coupled to the main body of the acoustic housing.

8. A musical instrument with vibrating rods to generate a sound, the musical instrument comprising:

an acoustic housing comprising a main body with a first opening and a second opening, the housing comprising an internal cavity within the main body extending from the first opening to the second opening;

a plurality of rods coupled to the acoustic housing, each rod in the plurality of rods extending beyond the first opening in the main body of the acoustic housing;

a ferromagnetic cap coupled to the second opening of the main body of the acoustic housing; and an electromagnetic pickup coupled to the acoustic housing and separated a distance away from the ferromagnetic cap;

wherein a vibration of any one of the plurality of rods enables the main body of the acoustic housing and ferromagnetic cap to resonate, thereby enabling the electromagnetic pickup to generate an electrical signal corresponding to the sound.

9. The musical instrument of claim 8, wherein the electromagnetic pickup is slidably mounted to the acoustic housing, the electromagnetic pickup configured to slidably adjust relative to the acoustic housing to adjust the distance between the ferromagnetic cap and electromagnetic pickup.

10. The musical instrument of claim 9, wherein each rod in the plurality of rods comprises a first length that is different than a second length of another rod in the plurality of rods.

* * * * *